United States Patent [19]

Sovey et al.

[11] Patent Number: 4,466,242

[45] Date of Patent: Aug. 21, 1984

[54] RING-CUSP ION THRUSTER WITH SHELL ANODE

[75] Inventors: James S. Sovey, Strongsville; Vincent K. Rawlin, Wellington; Robert F. Roman, Brook Park, all of Ohio

[73] Assignee: The United States of America as represented by the Administrator of the National Aeronautics and Space Administration, Washington, D.C.

[21] Appl. No.: 473,498

[22] Filed: Mar. 9, 1983

[51] Int. Cl.[3] ..... F03H 5/00

[52] U.S. Cl. ..... 60/202

[58] Field of Search ..... 60/202; 313/154, 161, 313/361.1, 362.1

[56] References Cited

U.S. PATENT DOCUMENTS

| | | | |
|---|---|---|---|
| 2,892,114 | 6/1959 | Kilpatrich | 313/63 |
| 3,156,090 | 11/1964 | Kaufman | 60/202 |
| 3,209,189 | 9/1965 | Patrick | 313/63 |
| 3,290,541 | 12/1966 | Hertz | 60/202 |
| 3,620,018 | 11/1971 | Banks | 60/202 |
| 3,735,591 | 5/1973 | Burkhart | 60/202 |
| 3,969,646 | 7/1976 | Reader et al. | 313/359 |

OTHER PUBLICATIONS

Beattie et al., *Cusped Magnetic Field Mercury Ion Thruster,* Journal of Spacecraft and Rockets, vol. 14, No. 12, Dec. 1977.

"Magneto-Electrostatically Contained Plasma Ton Thruster"-by R. D. Moore; AIAA Paper No. 69-260; AIAA 7th Electric Propulsion Conference; Williamsburg, VA; Mar. 3-5, 1969.

*Primary Examiner*—Louis J. Casaregola

*Attorney, Agent, or Firm*—Norman T. Musial; John R. Manning; Gene E. Shook

[57] ABSTRACT

An improved ion thruster (10) for low specific impulse operation in the 1500 sec to 6000 sec range has a multicusp boundary field (48) provided by high strength magnets (30-38) on an iron anode shell (14) which lengthens the paths of electrons from a hollow cathode assembly (20). A downstream anode pole piece in the form of an iron ring (40) supports a ring of magnets (44) to provide a more uniform beam profile. A cylindrical cathode magnet (46) can be moved selectively in an axial direction along a feed tube (22) to produce the desired magnetic field at the cathode tip (24).

14 Claims, 1 Drawing Figure

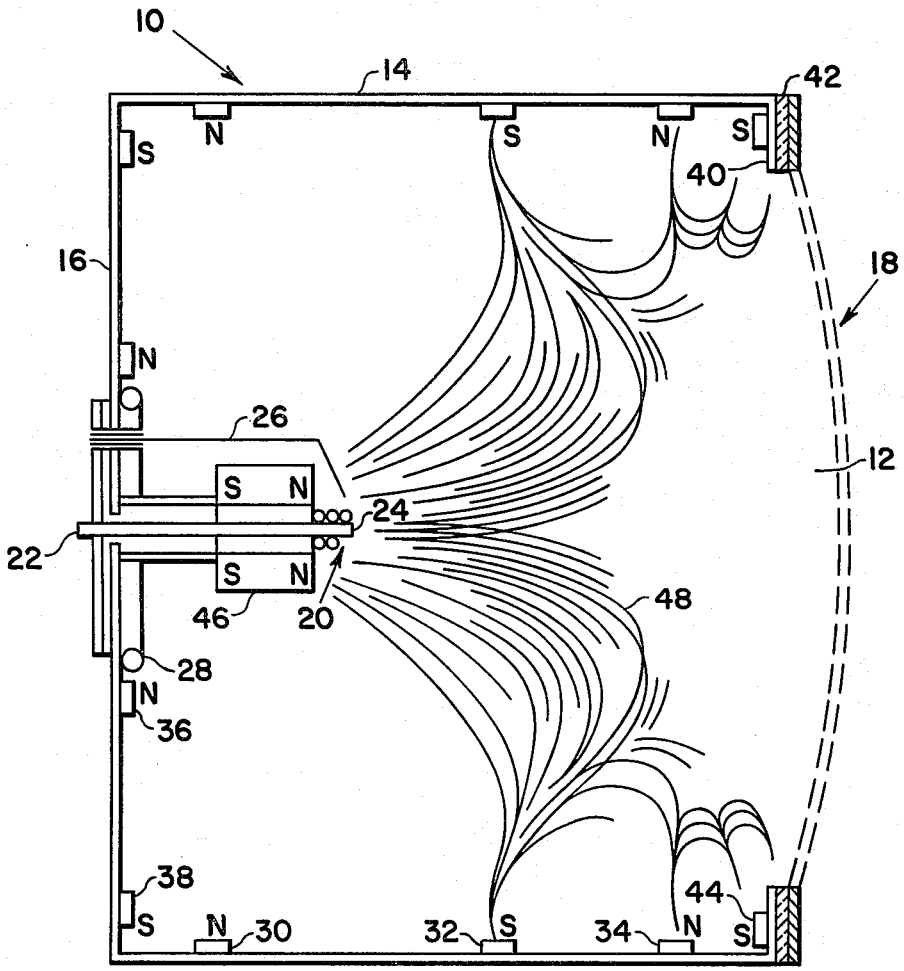
10
14
42
N
S
N
S
S
40
16
18
N
26
12
S N
24
22
S N
46
20
48
28
N
36
38
44
S
N
30
32
S
34
N
S

RING-CUSP ION THRUSTER WITH SHELL ANODE

ORIGIN OF THE INVENTION

The invention described herein was made by employees of the United States Government and may be manufactured and used by or for the Government for governmental purposes without the payment of any royalties thereon or therefor.

DESCRIPTION

TECHNICAL FIELD

This invention is directed to an improved ion thruster for low specific impulse operation in the 1500 sec to 6000 sec range. Efficient thruster performance at low specific impulse implies very low ion beam production costs and high propellant efficiency. The ion beam production cost is the discharge power per beam ampere while the propellant efficiency is defined as the in beam current divided by the discharge chamber propellant flow rate in equivalent amperes. This measured beam current is usually multiplied by a correction factor of 0.9 to 1.0 to account for multiply-charged ions.

Prior art ion thrusters generally utilized divergent magnetic fields or multipole magnetic fields to improve ion containment and lower ion production costs. These devices are described in "Advances in Electronics and Electron Physics" by H. R. Kaufman, vol. 36, 1974, pages 272–275. The divergent field configurations are basically composed of bar or rod magnets mild steel pole pieces at cathode potential. Such magnets are usually an iron, aluminum, nickel, cobalt alloy (Fe-Ni-Co). The electron collecting anode is a cylinder located outside of the divergent magnetic field.

Multipole thrusters are typically constructed with equally spaced magnet rings or pole pieces of alternating polarity. The magnets are usually Fe-Ni-Co or rare-earth materials, such as samarium-cobalt or platinum-cobalt. The manets and pole pieces are generally at cathode potential. Circular, electron collecting anode strips are usually placed between the magnet rings. The anode strips are positioned in the magnetic field between the magnets to set the discharge impedance.

The precision in locating the position of the anodes has been found to be critical. If a portion of the anode strip is located in weak magnetic field, electrons can stream to this portion of the anode producing plasma density asymmetries and anode hot spots. Field shaping in the region of the cathode is sometimes accomplished by either a cylindrical cathode magnet or circular pole piece - baffle assemblies.

The disadvantage of a diverging field thruster configuration is that minimum values of ion production cost below 140 watts per ion beam ampere have not been obtained with the gases mercury, zenon and argon. Operation with light gases such as argon have produced propellant efficiencies up ton only 0.80. Magnetic multipole thrusters using Fe-Ni-Co magnets have not demonstrated ion beam production costs below 180 W/A for inert gases. Maximum propellant efficiencies generally fall in the range of 0.7 to 0.9 for argon. Both of these thruster configurations do not show great promise for high thruster efficiencies at low specific impulse applications of 2000 sec for mecury or 3000 sec for argon. The relatively high ion production costs limit the thruster electrical efficiency at low specific impulse for most gases. Also, the propellant efficiencies for argon are unacceptably low.

Magnetic multipole thrusters of the type described in AIAA Paper No. 69–260 (1969) using very high magnetic flux densities of approximately 2000 G at pole pieces or magnets have shown low ion beam production costs. These devices also have demonstrated high propellant efficiencies with cesium, mercury, and xenon and have potential for high thruster efficiencies with light gases, such as argon. However, argon propellant efficiencies have not exceeded 0.90. One of the reliability problems associated with such a device is the large number of insulator assemblies required to support the anodes which are placed between the ring magnets. The probability of insulator contamination or local arc attachment and subsequent shorting may be high. This device suffers from the same problems as multipole thrusters. If a portion of the anode strip is located in a weak magnetic field, electrons can stream to this portion of the anode porducting asymmetries plasma density and hot anode spots with the resulting ultimate failure. Inasmuch as the magnets, pole pieces, and thruster shell generally are maintained at cathode potential, there exists a greater potential for sputter erosion problems because ions are accelerated through tens of volts.

Some ion sources used in controlled-nuclear fusion-related experiments use high flux density magnets and hollow cathodes. In addition, these ion sources are designed to have the entire discharge chamber shell at anode potential. This eliminates the need for anode strips used in devices similar to those described in the aforementioned AIAA Paper No. 69–260. In these devices, the ion production costs are very high and usually above 600 W/beam ampere.

BACKGROUND ART

Kilpatrick Pat. No. 2,892,114 is concerned with a continuous plasma generator having a shell which is an anode, a cathode, a propellant inlet tube, and a series of solenoid windings encircling the shell anode. This device utilizes a high voltage discharge, an axial rather than cusp magnetic field, and makes no provision for an acceleration system. The exhaust of this plasma generator would exhibit a wide spectrum of ion energies with an average ion exhaust velocity that is relatively low.

Patrick U.S. Pat. No. 3,209,189 is directed to a plasma generator having a shell which is connected to the positive terminal of a low voltage DC supply, a cylindrical member that is connected to the negative terminal of this low voltage supply, propellant gas inlets, and a magnet enclosing the shell. This device accelerates ions electromagnetically rather than electrostatically. The magnetic field is primarily axial, and the average ion exhaust velocities are relatively low.

Reader et al U.S. Pat. No. 3,696,646 describes an electron bombardment ion source which is to be employed as a means of propulsion in outer space. This ion surce has a shell, spaced anode sections which are interspersed with a series of magnetic pole pieces alternating in polarity, a cathode, and a propellant gas inlet. This device is essentially a multicusp ion beam source in which magnetic material serves as a segmented anode. Fe-Ni-Co magnets are usually employed in this type of device.

DISCLOSURE OF INVENTION

The ring-cusp thruster of the present invention utilizes a multicusp boundary field produced by rings of high strength magnets that are placed on an iron anode shell. This thruster includes a downstream anode pole piece on which a ring of magnets is positioned to provide a uniform ion beam profile.

The thruster also has a hollow cathode assembly that includes a cathode magnet which couples the magnetic field in the cathode region to a ring of magnets located on the anode shell near the center of the discharge chamber. This confines the electron current to the downstream ring cusps and the downstream anode pole piece. A discharge chamber is composed primarily of anode potential surfaces to reduce ion sputter etching of side and upstream discharge chamber walls. Also, a high perveance ion optical system reduces ion losses to its upstream grid.

The combination of these features reduces the minimum ion beam production costs to less than 90 watts per beam ampere. For example, propellant efficiencies in excess of 0.90 are readily achieved at 95 to 120 W/A for argon, krypton, xenon and mercury. In contrast, argon ion beam production costs below 140 W/A have not been obtained at propellant efficiencies greater than 0.80 using conventional divergent field thrusters.

BRIEF DESCRIPTION OF THE DRAWING

The details of the invention will be described in connection with the accompanying drawing which is a vertical section view of a ring cusp ion thruster having a shell anode constructed in accordance with the present invention. It should be noted that ground screening and neutralizer means are not shown.

Best Mode for Carrying Out the Invention

Referring now to the drawing, there is shown an electron bombardment ion thruster 10 of the type described in U.S. Pat. No. 3,156,090. The ion thruster 10 has a discharge chamber 12 within a tubular housing of iron which forms an anode shell 14. A flat back plate 16 of mild steel is mounted at the forward end of the chamber 12 in contact with the shell anode 14.

Ions are extracted and accelerated from the thruster 10 using a high perveance in optical system 18 mounted at the opposite end of the discharge chamber 12. The accelerator system 18 may use double grid ion optics described in the aforementioned U.S. Pat. No. 3,156,090. It is further contemplated that a three-grid ion optical system compatible with low specific impulse operation might be used. In this case, typical grid voltages might be: upstream grid, 500 V; middle grid, -1000V; downstream grid, near ground.

A hollow cathode assembly 20 is mounted at the center of the back plate 16. This assembly includes a central gas feed tube 22 having a cathode tip 24 at its extreme downstream end. A starting electrode 26 is provided to initiate an arc at the hollow cathode tip 24.

As shown in the drawing the accelerator system 18 preferably comprises a pair of dished grids. Ions are extracted using the high perveance of these dished grids. The dished ion accelerator system 18, hollow cathode assembly 20, and neutralizer (not shown) are standard ion thruster components. Reference is made to "Advances in Electronics and Electron Physics" by H. R. Kaufman, vol. 36, 1977, pages 272–275.

In operation, neutral gaseous propellant flows from the end of a perforated propellant feed tube 28 and from the hollow cathode 20 into the ionization chamber 12. A potential is applied to the starting electrode 26 and the cathode tip 24. Electrons emitted from the cathode initiate a discharge in a manner well known in the art.

The iron housing 14 is maintained at anode potential to receive electrons from the cathode 20. Electron paths are lengthened by a magnetic field in accordance with the present invention.

Electron access to anode surfaces is optimized by the magnetic field produced by magnets shown in the drawings. More particularly, the ion thruster 10 utilizes rings of magnets 30, 32 and 34 placed in the iron anode 14 together with rings of magnets 36 and 38 on the back plate 16 which is also at anode potential. This configuration results in a strong downstream ion flux with relatively low ion losses to side and upstream walls.

A downstream magnetic pole piece in the form of an iron ring 40 is mounted on the anode 14 adjacent to the accelerator system 18. This pole piece is maintained at anode potential. A suitable insulator 42 is interposed between the pole piece 40 and the upstream grid of the accelerator system 18. A ring of magnets 44 is mounted on the pole piece 40 to provide a more uniform beam profile.

The magnet rings 30–38 and 44 are preferably samarium-cobalt with pole-face flux densities of about 2500 gauss. Magnetic field penetration into the center of the chamber 12 is reduced in the region of ion optics 18 by the iron ring 40.

Another important feature of the invention is the provision of a cylindrical cathode magnet 46 which surrounds the cathode feed tube 22 and is adjacent to the cathode tip 24. The cathode magnet 46 can be moved selectively in an axial direction along the cathode feed tube 22 to produce the desired magnetic field at the cathode tip 24. A cylindrical cathode magnet producing an axial magnetic field at the cathode tip 24 of about 250 gauss has been satisfactory. Shown on the drawing is a sketch of an iron filing magnetic field map 48 produced by the cathode magnet 46 and the downstream rings of magnets.

The discharge is initiated by heating the cathode 20 with a coil heater in a manner known in the art. A high voltage pulse is applied between the cathode tip 24 and the starter electrode 26. The discharge is then established between the cathode 20 and the shell anode 14,16, 40. Nearly all the electron current is channeled to the cusp region of the two downstream magnetic rings 32 and 34 and the downstream ring 40 because of the magnetic field shaping. Also, most of the ion flux is directed away from the walls of the discharge chamber 12 and toward the ion optics 18 to be extracted as beam current. Only a small amount of ion flux is lost to the walls in the chamber 12. This unique feature produces the desired low ion production cost. More particularly, ion production costs of 90 watts per beam ampere or less may be attained in accordance with the present invention with candidate propellants such as Xe, Ar, Kr, Hg and others.

It is contemplated the invention can be used in thruster sizes varying between diameters of about 5 centimeters to at least 50 centimeters. It is further contemplated that the structure shown in the figure can be employed for space applications, as a ground based ion beam source for sputtering applications, or for neutral beam injection application for controlled-nuclear fusion systems. The device can use inert gases, reactive gases, or vaporized liquid metals.

As started above an ion thruster constructed in accordance with the present invention has resulted in ion beam production costs of about 90 W/A with potential for even more efficient ion production. Ion production costs below 140 W/A are not readily obtained using conventional divergent field thrusters. More particularly, the divergent field thrusters using argon have a propellant efficiency of about 0.70 at ion production costs in excess of 200 W/A. Magnetic multipole thrusters using low flux density magnets have generally demonstrated poor propellant efficiencies and ion production costs of at least 200 eV/ion for light gases such as argon.

Another advantage of the present invention is that most of the chamber surfaces that collect ions are at anode potential; thus, these ions usually fall through only a few volts rather than tens of volts which is the case of most prior art devices. The low energy ions will produce less sputter erosion to discharge chamber surfaces compared with the prior art devices.

Ion thrusters, constructed in accordance with the present invention, have demonstrated the lowest ion beam production costs for mercury and inert gases. Similar results may be obtained with other gases. Ion beam production costs less than 90 watts per ion beam ampere have been obtained. Based on the measurements of ion currents to the discharge chamber walls, even lower ion beam production costs should be readily obtained.

While the preferred embodiment of the invention has been disclosed and described it will be appreciated that various structural modifications may be made to the disclosed device without departing from the spirit of the invention and the scope of the subjoined claims. By way of example, the disclosed structure may be modified by moving the magnetic rings 30, 32, 34 and 44 on the iron anode 14 or downstream iron ring 40 to produce a configuration which gives a lower ion production cost, a more desirable ion beam profile, or effect changes in ion beam charge state.

We claim:

1. An improved ion thruster for low specific impulse operation in the 1500 sec to 6,000 sec range comprising a tubular anode shell forming a chamber for containing an ionizable propellant, a source of high velocity electrons within said chamber for bombarding said propellant to form ions, a high perveance optical system for extracting and accelerating ions from said chamber mounted on said anode shell at the downstream end of said chamber, said thruster having a back plate at anode potential mounted on the forward end of said anode shell thereby closing said chamber, a plurality of rings of magnets mounted on the inner surface of said tubular shell, and a plurality of rings of magnets mounted on the inner surface of said back plate to form with the magnets on the tubular shell a strong downstream ion flux to minimize ion losses to the side and upstream walls of said chamber.

2. An ion thruster as claimed in claim 6 wherein the anode 15 shell is iron.

3. An ion thruster as claimed in claim 1 wherein the magnet rings are samarium-cobalt.

4. An ion thruster as claimed in claim 3 wherein the magnet rings have pole-face densities of about 2500 gauss.

5. An ion thruster as claimed in claim 1 wherein the magnets on the back plate are samarium-cobalt.

6. An ion thruster as claimed in claim 1 including an iron ring mounted on said anode shell at the downstream end thereof adjacent to said ion optical system to form a downstream magnetic pole piece at anode potential, and a ring of magnets mounted on said iron ring thereby providing a uniform beam profile and reduce the magnetic field penetration into the center of aid chamber adjacent to said ion optical system.

7. An ion thruster as claimed in claim 1 wherein the electron source comprises a hollow cathode assembly having a central gas feed tube mounted at the center of said back plate, and a cylindrical magnet mounted on said feed tube to provide an axial magnetic field.

8. An ion thruster as claimed in claim 7 wherein said cylindrical magnet produces an axial magnetic field of about 250 gauss.

9. An ion thruster as claimed in claim 7 wherein the cylindrical magnet is slidably mounted on the feed tube whereby said cylindrical magnets may be moved selectively in an axial direction to produce a predetermined magnetic field at the tip of said cathode.

10. An electron bombardment ion thruster comprising a housing forming the peripheral wall of discharge chamber for containing an ionizable propellant, means for maintaining the surfaces of said peripheral wall of said discharge chamber at anode potential to reduce ion sputter etching of the side and upstream portions thereof, a source of propellant in communication with said discharge chamber, a cathode for emitting high velocity electrons to said peripheral wall for bombarding said propellant to form ions, ion optical means for extracting and accelerating ions from said discharge chamber, a plurality of high strength magnets mounted on said housing in said chamber to form a multicusp boundary field, a downstream anode pole piece adjacent to said ion optics means for providing a uniform ion beam profile, and a magnet mounted on said cathode to couple the magnetic field in the region thereof to said high strength magnets.

11. An electron bombardment ion thruster as claimed in claim 10 including a ring of magnets mounted on said downstream anode pole piece.

12. An electron bombardment ion thruster as claimed in claim 11 wherein the magnets are samarium-cobalt.

13. An electron bombardment ion thruster as claimed in claim 12 wherein the magnets have pole-face densities of about 2500 gauss.

14. An electron bombardment ion thruster as claimed in claim 10 wherein the magnet on the cathode is movably mounted thereon for selective movement in an axial direction to produce a predetermined magnetic field at the tip of the cathode.

* * * * *

UNITED STATES PATENT OFFICE

CERTIFICATE OF CORRECTION

Patent No. 4,466,242 Dated August 21, 1984

Inventor(s) James S. Sovey et al

It is certified that error appears in the above-identified patent and that said Letters Patent are hereby corrected as shown below:

Column 1, line 32, after "magnets" insert--and--
line 59, cancel "ton" and insert--to--

Column 3, line 47, cancel "in" and insert--ion--

Column 5, line 64, cancel "6" and insert--1--
line 65, cancel "15"

Column 6, line 31, after "of" insert--a--

Signed and Sealed this

Second Day of April 1985

[SEAL]

*Attest:*

DONALD J. QUIGG

*Attesting Officer* *Acting Commissioner of Patents and Trademarks*